United States Patent [19]

Buzzi

[11] Patent Number: 4,619,130

[45] Date of Patent: Oct. 28, 1986

[54] APPARATUS FOR PROVIDING A RIM ON THE TIPS OF BALLPOINT

[75] Inventor: Ugo Buzzi, Arzo, Switzerland

[73] Assignee: Buzzi & Co. S.A., Chiasso, Switzerland

[21] Appl. No.: 723,932

[22] Filed: Apr. 16, 1985

[30] Foreign Application Priority Data

Apr. 26, 1984 [CH] Switzerland ..... 2039/84

[51] Int. Cl.[4] ..... B21D 41/04

[52] U.S. Cl. ..... 72/124; 72/126; 29/441 BP

[58] Field of Search ..... 29/441 BP; 72/91, 124, 72/126, 112

[56] References Cited

U.S. PATENT DOCUMENTS 2,992,572 7/1961 Lockart ..... 29/441 BP
3,009,240 11/1961 Brown ..... 29/441 BP
3,273,368 9/1966 Sporck ..... 72/126

FOREIGN PATENT DOCUMENTS 346132 6/1960 Switzerland ..... 72/124

*Primary Examiner*—Lowell A. Larson
*Attorney, Agent, or Firm*—Young & Thompson

[57] ABSTRACT

The apparatus allows providing a rim on the tips for ballpoint pens even if made of a very hard material, such as stainless steel, as it can withstand very great pressure. It comprises a first body (1) rotating about an axis (8) which coincides with the axis of the tip (10) to be provided with a rim. The body (1) is provided with an eccentric hole (11) on whose axis (9) a second body (3) rotates on first rolling bearings, in which second body (3) a pivot (5) rotates coaxially on second rolling bearings. The pivot (5) contacts on its inner end (5'') a pushing member (12) and on its external end a first convergent conical surface (5') which presses directly on the edge (6) of the tip to be provided with a rim with the aid of a second divergent conical surface (3' ) joined to the second body (3). The two surfaces (3'and 5') are such as to constitute the angle $\alpha$ which is most suitable for providing a rim on the edge (6) of the tip (10) by retaining the ball with the desired clearance.

4 Claims, 2 Drawing Figures

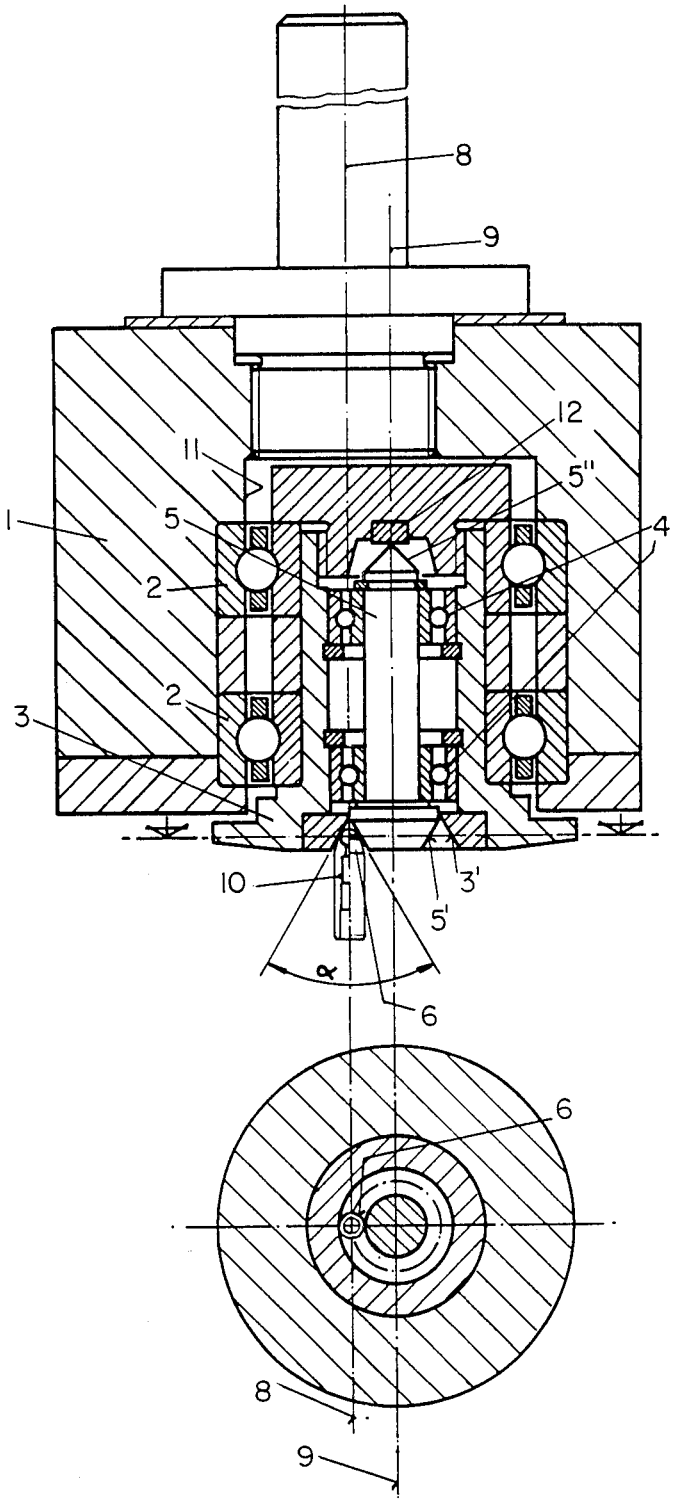
8
9
12
11
5"
1
5
4
2
2
3
10
3'
5'
α
6
6
8
9

APPARATUS FOR PROVIDING A RIM ON THE TIPS OF BALLPOINT

The present invention has as its object an apparatus for providing a rim on the tips for ballpoint pens. It is also particularly well-suited for tips made of a very hard material, such as for example stainless steel.

Various apparatus for providing a rim on the tips of ballpoint pens are known. Reference is made for this matter to the Italian Pat. No. 563,245 and the Swiss Pat. No. 605,167.

The apparatus according to the present invention has various advantages over known apparatus. First of all, it is easy to construct, solid and capable of withstanding considerable axial pressures.

The present apparatus is characterized by a first body rotating about an axis which coincides with the axis of the tip to be provided with a rim, said body being provided with an eccentric hole about whose axis a second body rotates on first rolling means, in said second body a pivot rotates coaxially by means of second rolling means, said pivot being provided on its inner end with pushing means and on its outer end with a first convergent conical surface which presses directly on the edge of the tip to be provided with a rim with the aid of a second divergent conical surface joined to said second body and such as to constitute, together with the first surface, the angle which is most suitable for providing a rim on the edge of the tip to be provided with a rim.

The accompanying drawing represents a preferred non-limiting and non-binding embodiment of the present apparatus.

FIG. 1 shows the axial section of the entire apparatus.

FIG. 2 shows a plan view from below of the detail of the tip to be provided with a rim with the corresponding two surfaces for providing the tip with a rim.

The apparatus comprises: the first body 1 rotating about the axis 8 which coincides with the axis of the tip 10 to be provided with a rim.

The body 1 is provided with the eccentric hole 11 on whose axis 9 (which does not coincide with the axis 8) rotates the second body 3 on ball-bearings 2.

The inside of the body 3 is hollow and the pivot 5 rotates coaxially therein by means of ball bearings 4.

The inner end 5'' of the pivot 5 has a conical shape and presses against the flat piece 12 joined to the body 3, said piece 12 being used as a support for supporting the pushing force.

Th outer end of said pivot 5 has a convergent conical surface 5' which presses against the edge 6 of the tip to be provided with a rim with the aid of the divergent conical surface 3' on the second body 3.

The angle $\alpha$ constituted by the two conical surfaces 5' and 3' and their shape are such as to provide the edge 6 of the tip to be provided with a rim with the most suitable shape for retaining the ball with the desired clearance.

To this end the shapes of the two surfaces 5' and 3' can also be different from each other.

When the edge 6 contacts the surfaces 3' and 5', the bodies 3 and 5 roll on the axis 9 independently from each other.

For this reason, there is no sliding contact but only revolving friction between the edge 6 of the tip to be provided with a rim and the surfaces 3' and 5'.

This allows the apparatus to withstand considerable axial pressures as required for providing a rim on the tips of ballpoint pens made of a hard material such as for example stainless steel.

As can be seen from the drawing, the body 3 is a cylindrical sleeve which supports on its interior the bearings 4. Body 3 includes a cylindrical shank having a cylindrical outer surface on which are supported the inner races of the bearings 2 at opposite ends of this shank.

Similarly, the pivot 5 has a cylindrical shank on whose cylindrical outer surface are supported the inner races of the bearings 4, at opposite ends of this cylindrical shank.

It is also to be noted from the drawing that the bearings 4 axially overlap the bearings 2.

The shape and constitution of the various components of the present apparatus can be varied in accordance with the claims without departing from the scope of protection of the patent.

I claim:

1. Apparatus for providing a rim on the tips for ballpoint pens even if made of a very hard material, comprising a first body (1) rotating about an axis (8) which coincides with the axis of the tip (10) to be provided with a rim, said body (1) being provided with an eccentric hole (11) about whose axis (9) a second body (3) rotates on first rolling means (2), in said second body (3) a pivot (5) rotates by means of second rolling means (4) supported on the inside of said second body (3), said pivot (5) being provided on its inner end (5'') with pushing means (12) and on its outer end with a first convergent conical surface (5') which presses directly on the edge (6) of the tip to be provided with a rim with the aid of a second diverging conical surface (3') joined to said second body (5) and such as to constitute, together with the first surface (5') the angle $\alpha$ which is most suitable for providing a rim on the edge (6) of the tip (10) to be provided with a rim.

2. Apparatus as in claim 1, in which the second body (3) has a cylindrical shape, the first rolling means (2) and the second rolling means (4) are constituted by bearings, the pushing means for the pivot (5) are obtained by providing the inner end of the pivot (5'') with a conical shape and by pressing said end against a flat piece (12) fixed on the second body (3).

3. Apparatus as in claim 1, in which the two surfaces (3', 5') which rest against the edge (6) of the tip (10) for ballpoint pens are shaped so as to be better adapted to the shape to be given to said edge so that this edge retains the ball with the desired clearance, said shaping of one surface being able to be different from that of the other surface.

4. Apparatus as claimed in claim 1, in which said second body (3) and said pivot (5) each have a cylindrical shank, the cylindrical shank of the pivot being disposed inside the cylindrical shank of the second body, said first and second rolling means (2, 4) comprising bearings disposed adjacent opposite ends of each of said shanks, said shanks of said second body and pivot axially overlying each other.

* * * * *